United States Patent [19]

McGarry

[11] Patent Number: 4,755,644

[45] Date of Patent: Jul. 5, 1988

[54] SWITCH POSITION INDICATOR

[75] Inventor: Stephen P. McGarry, Rochester Hills, Mich.

[73] Assignee: United Technologies Automotive, Inc., Dearborn, Mich.

[21] Appl. No.: 69,135

[22] Filed: Jul. 2, 1987

[51] Int. Cl.[4] ..... H01H 9/00

[52] U.S. Cl. ..... 200/317

[58] Field of Search ..... 200/61.84, 52 R, 308, 200/310, 311, 312, 314, 315, 317; 116/279, 303, 307

[56] References Cited

U.S. PATENT DOCUMENTS

| | | | |
|---|---|---|---|
| 2,260,592 | 10/1941 | Winning | 200/317 X |
| 3,683,145 | 8/1972 | Berenbaum et al. | 200/308 |
| 3,845,736 | 11/1974 | Golbeck et al. | 116/279 |
| 3,855,959 | 12/1974 | Hinze | 116/279 |
| 4,187,419 | 2/1980 | Warren | 200/308 |
| 4,205,533 | 6/1980 | Sterling | 200/317 X |
| 4,280,031 | 7/1981 | Kondo et al. | 200/314 |
| 4,420,664 | 12/1983 | Takahashi | 200/308 |

*Primary Examiner*—J. R. Scott

[57] ABSTRACT

A switch position indicator for use in indicating the status of a push button type switch or a plurality of push button switches. A switch front (350) includes windows (352, 354) which may be selectively illuminated to advise the operator of the status of the switch. A pivoted spring (310) driven by cams (304, 306) connected to portions of the switch is utilized to control the position of a shade (312) for covering and uncovering the selected window openings to indicate the status of the switch.

13 Claims, 3 Drawing Sheets

SWITCH POSITION INDICATOR

CROSS REFERENCE TO RELATED APPLICATIONS

This application relates to commonly assigned copending U.S. application Ser. No. 069,127, filed July 2, 1987, entitled "A Latching Switch Operated by Sequential Push Motions" and U.S. application Ser. No. 069,134, filed July 2, 1987, entitled "Modular Push Type Latching and Cross Cancelling Switches".

TECHNICAL FIELD

The field to which this invention pertains is the field of electrical switches and, specifically, the field of indication mechanisms to alert an operator as to the position of various switches.

BACKGROUND OF THE INVENTION

The present invention is directed to a tell-tale type alert mechanism for selectively illuminating indicator windows to advise an operator of the status of various switches. This mechanism is designed to be compatible with modular push-push type switches and modular cross cancelling type switches such that the components of the switch may be utilized to drive appropriate cams which interact with a spring to displace an opaque shade between various positions to selectively cover and uncover the indicator windows. In this manner, the operator is advised by which windows are illuminated as to the operational status of the switch.

In automotive applications and especially in those where push button switches are used, it is important for the operator to understand the condition of the switch. For instance, in a light switch for use in a motor vehicle, the switch may have an "off" position, a parking light position, and a headlight position. In the "off" position, none of the lights are energized. In the parking light position, only the parking lights are energized, and in the headlight position, the driving lights of the car are energized. Since it is desirable not to have the parking lights and the driving lights energized by displacing both switches simultaneously, a cross cancelling switch is utilized. This type of cross cancelling switch may be a push button switch wherein the condition of the switch is not readily apparent by observation. For instance, in rotating switches the knob itself may indicate the position of the switch, however, with push button switches it is difficult to tell whether the switch is in the "on" or "off" position, since the push button may remain in the same position whether the switch itself is "on" or "off". Hence, the use of a tell-tale or alert mechanism is utilized in combination with push buttons switches to advise the operator of the appropriate status of the switch.

SUMMARY OF THE INVENTION

It is an object of the present invention to provide a switch position indicator.

It is another object of the present invention to utilize the working components of a switch mechanism as a source for indicating the position of the switch and for controlling the position of a tell-tale indicating to an operator the position of the switch.

It is a yet further object of the present invention to provide a simple control mechanism for regulating the position of an opaque shade for selectively blocking the illumination of indicator windows.

It is still another object of the present invention to provide a safe, economical, reliable, easy to assemble and repair position indicator mechanism for use with a switch.

Other objects will be apparent from the description to follow and the appended claims.

The above objects are achieved according to a preferred embodiment of the invention by a switch position indicator for use with means for illumination and a switch, including a switch front defining at least one indicator window which may be illuminated from the back side of the window front. A moveable opaque shade for selectively covering the indicator window such that an observer of the indicator window may readily ascertain whether or not the indicator window is illuminated together with means for positioning the moveable shade in response to the position of the switch are disclosed. The means for positioning the moveable shade includes a spring extending to the shade for effecting displacement of the shade and a cam means connected to a portion of the switch, said cam means being positioned in response to the switch position and said cam means including appropriate cam lobes which engage the spring means whereby upon the position of the switch being changed, the position of the cam means is changed thereby causing the appropriate cam lobe to contact the spring means thereby displacing the spring means to place the shade in the desired position to allow illumination of the window indicator, if appropriate, based upon the position of the switch.

Further disclosed is an apparatus for controlling the illumination of indicator windows to indicate a switch position selected by operation of a switch including a switch means having moveable electric contacts and a rotatable cam having an alignment post which extends through a switch housing and which indicates, based upon its rotational position, the selected switch position. The cam is mounted to the alignment post and is capable of being displaced with the alignment post. A displaceable shade for selectively blocking light from the indicator window is connected to a spring extending from the housing to the shade, said spring engaging the cam and being responsive to displacement of the cam to cause displacement of the shade.

PREFERRED EMBODIMENT OF THE INVENTION

The herein invention will be described with reference to modular push-push latching cross cancelling switches arranged adjacent each other and in reference to a single modular latching switch. It is certainly to be understood that this invention has applicability to other types of switches, to switches which operate in different manners, and to switches having different numbers of push buttons or other elements.

Figure 1:
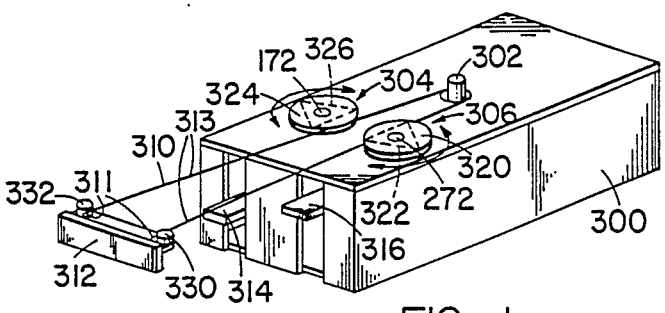
FIG. 1 is a perspective view of a modular cross cancelling switch within a housing together with a switch position indicator.

Referring first to FIG. 1, there is seen a switch housing 300 in which the various switch components are contained. Switch actuators 314 and 316 are push buttons designed to separately energize or deenergize each switch or to energize one switch and cancel the other switch to obtain a desired cross cancelling effect. Alignment posts 172 and 272 are shown extending upwardly out of the housing and have mounted thereon cams 304 and 306 respectively. These alignment posts are the same alignment posts as may be seen in FIG. 3 as part of the rotatable cams.

Spring 310 is shown mounted about pivot 302 affixed to housing 300 and extending to shade 312. It may further be seen that spring 310 is captured under a portion of cams 304 and 306 such that it is maintained in the position as shown in FIG. 1.

Figure 2C:
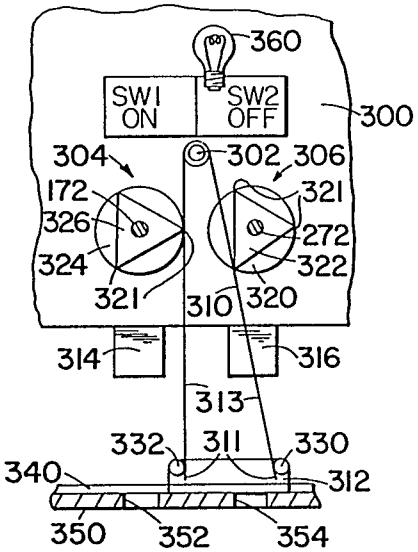
FIGS. 2A–2C are top plan views of the position indicator mechanism showing the shade in various positions depending upon the switch positions.
Figure 2B:
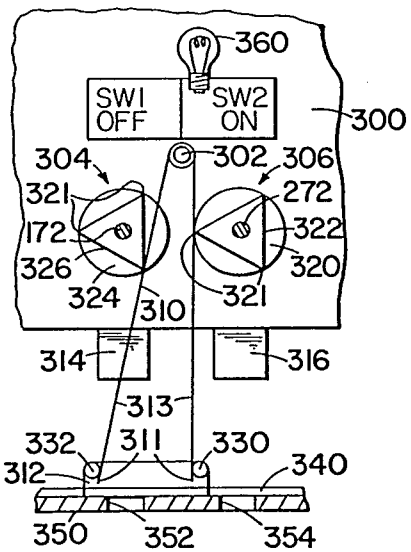
Figure 2A:
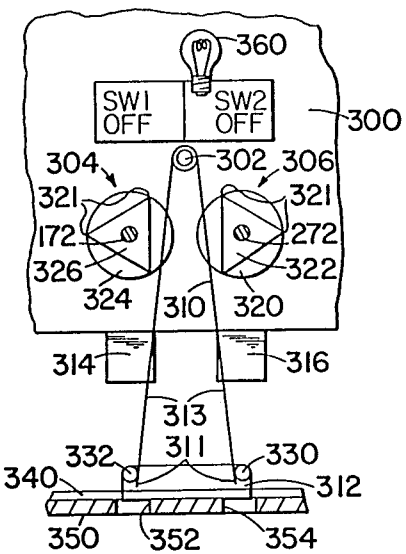

FIGS. 2A, 2B, and 2C are top plan views of the mechanism shown with the respective switches in various positions. In FIG. 2A, it may be seen that cams 304 and 306 are arranged such that cam lobes 321 do not contact spring 310 and such that opaque shade 312 is capable of being positioned anywhere between the range of arc about which the shade could slide without spring 310 engaging the cams. In this position, both switches (switch 1 and switch 2) are "off" and light 360 contained within the switch housing is not energized such that there is no illumination supplied to any indicator window and whether or not the shade blocks light to the windows, the operator will see no light and it will be indicated that both switches are "off".

Referring now to FIG. 2B, it may be seen that the right-hand switch has been placed in the "on" position while the left-hand switch remains in the "off" position. By placing the right-hand switch in the "on" position, cam 306 has been rotated 60° and one of the lobes 321 has been moved into contact with spring leg 313. As the cam is rotated into contact with spring leg 313, the spring is displaced to the left and spring ends 311 coacting with pins 330 and 332 of shade 312 act to displace the shade to the left covering the first window 352. Light 360 is energized with one of the switches being "on", hence the second window 354 is illuminated and the first window 352 is not illuminated. Presumably, markings on switch front 350 will indicate that switch 2 corresponds to second window 354 and the operator by observing the marking adjacent the second window which is now illuminated will now observe that switch 2 is turned "on".

Referring now to FIG. 2C, it may be seen that switch 1 has been turned "on" and switch 2 has been turned "off". The positions of the cam lobes as shown in FIG. 2B have been reversed in FIG. 2C. More specifically in FIG. 2C, it may be seen that cam 304 includes flange 324 and cam body 326. Flange 324 is of significantly greater diameter than the cam lobes of cam body 322 and extends outwardly therefrom. As may be seen from both FIG. 2C and FIG. 1, the flange is mounted spaced from the enclosure with the cam body therebetween such that a gap is provided. Spring leg 313 is captured between the cam flange and the housing or enclosure of the switch such that it is maintained in the desired position. Additionally shown in FIG. 2C is cam 306 having cam body 322 and flange 320. Flange 320 likewise traps leg 313 of spring 310 between the flange and the enclosure.

As seen in FIG. 2C, cam 304 has displaced spring leg 313 to the right upon displacement of the cam lobe and since the cam lobe of cam 306 has been rotated out of the way, the entire spring assembly moves to the right displacing with it shade 312 to the right. With the shade in the position shown in FIG. 2C, second window 354 is covered and the first window 352 is uncovered. In this position, illumination from light 360 illuminates the first window 352 and does not illuminate second window 354, and hence the operator is advised that switch 1 is "on" and switch 2 is "off".

Figure 3:
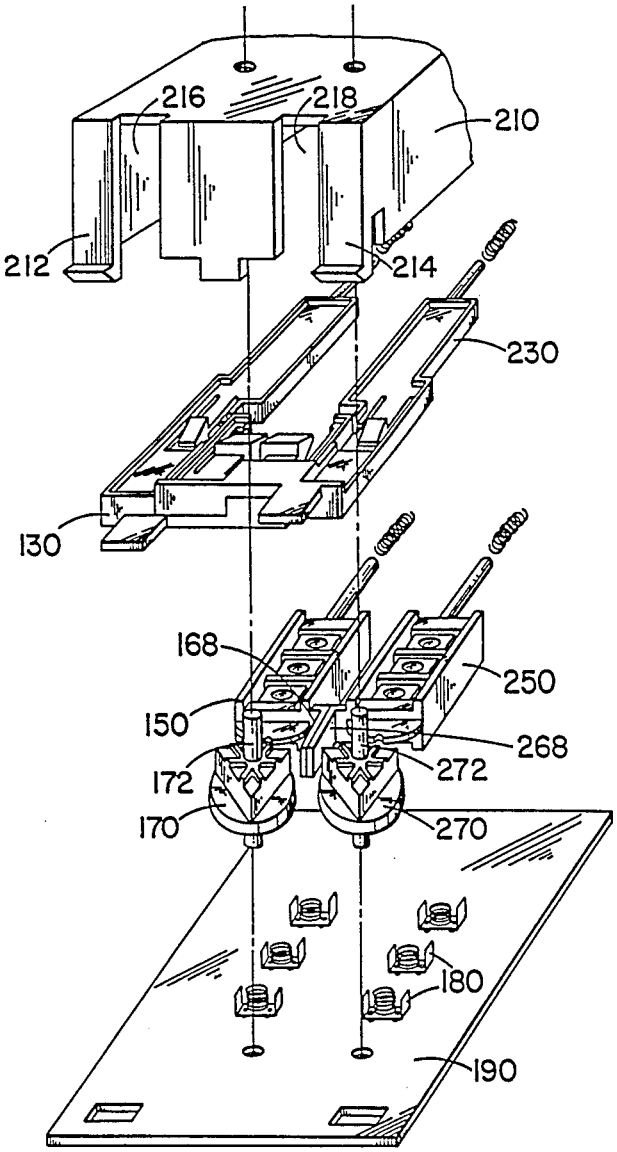
FIG. 3 is a perspective view of a modular push-push latching cross cancelling switch.

Referring now to FIG. 3, it may be seen an exploded perspective view of modular push-push latching cross cancelling switches as can be used within housing 300.

Housing 210 is shown having the legs extending downwardly therefrom and slots into which the push buttons of cam actuators 130 and 230 may extend. Contact carriers 150 and 250 are provided adjacent to rotatable cams 170 and 270 which interact with the contact carriers to control the position of the contact carriers. Interference tabs 168 and 268 extend outwardly from each contact carrier adjacent each other and adjacent the rotatable cams. The printed circuit board 190 mates with housing 210 to define the enclosure in which the components are mounted. Housing 210 has legs 212 and 214 extending downwardly and slots 216 and 218 into which the push buttons from the cam actuators extend. Electrical contacts 180 and the springs attached thereto are shown for mounting within contact carriers 150 and 250. Additional contacts (not shown) may be provided on printed circuit board 190 forming the base of the enclosure such that upon appropriate displacement of the contact carriers, appropriate electrical connections are made. For a more detailed description of the switches and their manner of operation, please see the two patent applications cross referenced herein (Ser. Nos. 069,127 and 069,134, both filed on July 2, 1987.)

Figure 4:
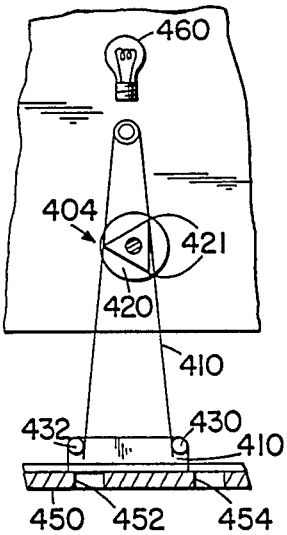
FIG. 4 is a top plan view of a switch position indicator for a single modular push-push switch.

Referring now to FIG. 4, there may be seen an alternative embodiment of the switch position indicator mechanism. In this embodiment, the switch mechanism has but a single contact carrier such as is disclosed in cross referenced U.S. Patent Application entitled "A Latching Switch Operated by Sequential Push Motions" (U.S. patent application Ser. No. 069,127, filed on July 2, 1987). A single rotatable cam is utilized to displace a single contact carrier to obtain the desired switching effect. In this switch, cam 404 having cam lobes 421 and flange 420 is arranged such that the legs of spring 410 are located on either side of the cam lobes. Shade 412 having pins 430 and 432 is engaged by the legs of the spring in the same manner as shown in FIGS. 1 and 2. Again, switch front 450 includes first window 452 and second window 454 which are selectively blocked and uncovered by the positioning of the spring as determined by cam 404. In like manner, a single modular switch would have the cam located on one side of the spring as long as the spring is in some manner biased to return to a position that is different from the position to which the spring is directed when the cam lobe displaces the spring. Light source 460 is also shown.

Figure 5:
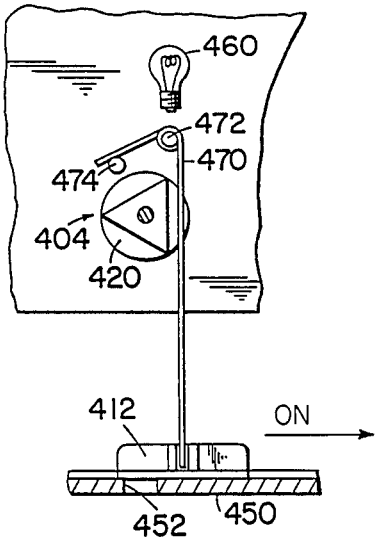
FIG. 5 is a top plan view of another embodiment of a switch position indicator for a single modular push-push switch.

In FIG. 5, window front 450 is shown having window 452. Shade 412 is mounted for sliding motion to the window front and has portions of distinct observability. For instance, half the shade may be clear and half black or half red and half black. Hence, by positioning spring 470 the particular portion of the shade located in the window is observable by the operator to identify the condition of the switch.

Spring 470 is mounted about pivot point 472 and secured to projection 474 and shade 430. Cam 420 having cam surface 404 acts to displace the spring to displace the shade to indicate the condition of the switch. Light source 460 is also shown. When shade displaced to the right in the "on" direction as indicated in the drawing, window 452 is illuminated by light source 460 to indicate to the observer that the switch is in the "on" position.

It is to be understood that other variations can be provided wherein a spring mechanism in contact with the cam is utilized to displace the mechanism for uncovering and covering windows to advise an operator as to the status of the switch.

The invention has been described with reference to a particular embodiment herein, however, it will be understood by those skilled in the art that variations and modifications can be effected within the spirit and scope of the invention.

We claim:

1. A switch position indicator for use with means for illumination and a switch including a switch front defining at least one indicator window which may be illuminated from the back side of the window front which comprises:

a moveable opaque shade for selectively covering the indicator window such that an observer of the indicator window may readily ascertain whether or not the indicator window is illuminated; and means for positioning the moveable shade in response to the position of the switch including spring means extending to the shade for effecting displacement of the shade and a cam means connected to a portion of the switch, to be positioned in response to the switch position and said cam means including appropriate cam lobes which engage the spring means whereby upon the position of the switch being changed, the position of the cam means is changed thereby causing the appropriate cam lobes to contact the spring means thereby displacing the spring means to place the shade in the desired position to allow illumination of the window indicator based upon the position of the switch.

2. The apparatus as set forth in claim 1 wherein the spring means comprises a V-shaped torsion spring mounted for rotation about a pivot point and includes spring ends secured to the shade and wherein the cam lobes contact at least one leg of said spring to effect displacement thereof.

3. The apparatus as set forth in claim 2 wherein the cam means comprises a cylindrical cam body and reduced diameter portion having a plurality of cam lobes, the cylindrical cam body being spaced on the opposite side of the cam lobes from the switch to allow the spring means to be captured between a portion of the switch and the cam body while being appropriately displaced by the cam lobes.

4. The apparatus as set forth in claim 3 wherein the switch includes a pair of cross cancelling switches each having a rotatable cam, and said cam means further comprising a pair of cams one connected to each of the rotatable cams and each engaging one of the legs of the spring means.

5. The apparaus as set forth in claim 1 wherein the shade is mounted to the back of the window front and includes means for securing the shade in position while allowing reciprocal sliding motion of the shade.

6. Apparatus for controlling an observable signal within an indicator window to indicate a switch position selected by operation of a switch which comprises:

a switch means having moveable electric contacts and a rotatable cam having an alignment post which extends through a switch housing and which indicates, based upon its rotational position, the selected switch positon;

a second cam mounted to the alignment post and capable of being displaced with the alignment post;

a displaceable shade means for selectively providing an observable signal at the indicator window; and a spring means extending from the housing to the shade means, said spring means engaging said second cam and being responsive to displacement of said second cam to cause displacement of the shade means.

7. The apparatus as set forth in claim 6 wherein said second cam comprises cam lobes as a portion of a cam body adjacent the housing and a flange having a greater diameter than the cam body and spaced from the housing by the cam body, said spring means being captured between the flange and the housing.

8. The apparatus as set forth in claim 7 wherein the spring means comprising a torsion spring having a pivot point on the housing and a leg extending from the housing to the shade means, said leg being captured by the flange and positioned to be contacted by the cam body.

9. The apparatus as set forth in claim 8 wherein the spring is V-shaped and has two legs, each of which extends to the shade means.

10. The apparatus as set forth in claim 9 wherein the switch has a pair of rotatable cams and further comprising:

two cams, one connected to the alignment post of each rotatable cam and whrein each of said two second cams contacts a separate leg of the spring means whereby depending upon the position of the switch, the dispaceable shade means is positioned to control illumination of an indicator window.

11. The apparatus as set forth in claim 6 wherein the displaceable shade means further comprises said shade means having at least two observably distinct portions, said portions when observable at the indicator window indicating the condition of the switch.

12. The apparatus as set forth in claim 11 wherein the two observably distinct portions include two portions of different colors.

13. The apparatus as set forth in claim 11 wherein the two observably distinct portions include one portion allowing illumination to be seen at the indicator window.

* * * * *

UNITED STATES PATENT AND TRADEMARK OFFICE

CERTIFICATE OF CORRECTION

PATENT NO. : 4,755,644

DATED : July 5, 1988

INVENTOR(S) : Stephen P. McGarry and Robert C. Burdick

It is certified that error appears in the above-identified patent and that said Letters Patent is hereby corrected as shown below:

Title page:

Element (75): Please add Robert C. Burdick, Romulus, Michigan, as a co-inventor.

Column 5, line 8, after "shade", please insert --412 is --.

Column 6, claim 6, line 16, after "switch", please delete "positon" and insert --position--.

Column 6, claim 10, line 44, after "two", please insert --second--.

Column 6, claim 10, line 45, after "and", please delete "whrein" and insert --wherein--.

Signed and Sealed this

Twenty-ninth Day of November, 1988

*Attest:*

DONALD J. QUIGG

*Attesting Officer*

*Commissioner of Patents and Trademarks*